US009598654B1

(12) United States Patent
Pisklak

(10) Patent No.: US 9,598,654 B1
(45) Date of Patent: Mar. 21, 2017

(54) FUEL COMPOSITIONS FOR CATALYTIC BURNERS

(71) Applicant: Stonewick, Inc., Dallas, TX (US)

(72) Inventor: Thomas J. Pisklak, Cypress, TX (US)

(73) Assignee: Stonewick, LLC, Dallas, TX (US)

( * ) Notice: Subject to any disclaimer, the term of this patent is extended or adjusted under 35 U.S.C. 154(b) by 526 days.

(21) Appl. No.: 13/843,214

(22) Filed: Mar. 15, 2013

Related U.S. Application Data

(63) Continuation-in-part of application No. 11/974,455, filed on Oct. 12, 2007, now Pat. No. 9,279,583.

(60) Provisional application No. 60/851,235, filed on Oct. 12, 2006.

(51) Int. Cl.
*C10L 1/10* (2006.01)
*C10L 1/19* (2006.01)
*C10L 1/182* (2006.01)
*C10L 1/185* (2006.01)

(52) U.S. Cl.
CPC ..... *C10L 1/19* (2013.01); *C10L 1/1824* (2013.01); *C10L 1/1857* (2013.01)

(58) Field of Classification Search
CPC ..... C10L 1/02; C10L 1/14
USPC ..... 431/7; 44/251, 301
See application file for complete search history.

(56) References Cited

U.S. PATENT DOCUMENTS 4,084,940 A * 4/1978 Lissant ..... C10L 1/328 44/301
4,392,865 A * 7/1983 Grosse ..... C10L 1/106 44/281
6,537,061 B1 * 3/2003 Gomez ..... A01M 1/2088 431/268
6,814,929 B2 * 11/2004 Lehoux ..... A01N 31/08 422/123
7,662,402 B2 * 2/2010 Oohira ..... A01N 37/34 424/405
8,062,389 B2 * 11/2011 Pisklak ..... C10L 1/02 44/308
8,318,981 B2 * 11/2012 Kamiyama ..... A01N 37/52 504/343
8,367,583 B2 * 2/2013 Saito ..... A01N 25/00 504/100
8,697,695 B2 * 4/2014 Sakamoto ..... A01N 43/56 514/235.8
8,747,492 B2 * 6/2014 Horton ..... B01J 21/16 44/451
8,974,552 B2 * 3/2015 Clark ..... C10L 1/023 44/451
2007/0112068 A1 * 5/2007 Oohira ..... A01N 37/34 514/526
2007/0153519 A1 * 7/2007 Sexton ..... A61L 9/037 362/253
2007/0202450 A1 * 8/2007 Pisklak ..... F23D 3/02 431/320
2008/0014539 A1 * 1/2008 Pisklak ..... C10L 1/02 431/268
2009/0193711 A1 * 8/2009 Clark ..... C10L 1/023 44/451
2012/0022055 A1 * 1/2012 Sakamoto ..... A01N 47/24 514/229.2
2012/0091218 A1 * 4/2012 Mikkelsen ..... A61L 9/048 239/6
2013/0157922 A1 * 6/2013 Mikkelsen ..... A61L 9/012 512/4
2013/0202788 A1 * 8/2013 Mikkelsen ..... A61L 9/048 427/212

OTHER PUBLICATIONS

California Air Resource Board regulations for Reducing Emissions from Consumer Products, 2008, http://www.arb.ca.gov/consprod/regs/2008/cp.pdf.*
Occupational Safety and Health Administration guidlines, 1988, http://www.cdc.gov/niosh/docs/81-123/pdfs/0004.pdf.*
2-propanol, MSDS, http://avogadro.chem.iastate.edu/MSDS/2-propanol.htm, 2001.*

* cited by examiner

*Primary Examiner* — Jorge Pereiro
(74) *Attorney, Agent, or Firm* — Winstead PC

(57) ABSTRACT

Fuels compositions based on exempt compounds are provided. These fuels are useful in catalytic burner systems that can be used to disperse fragrances, insecticides, insect repellants (e.g., citronella), aromatherapy compounds, medicinal compounds, deodorizing compounds, disinfectant compositions, fungicides and herbicides.

7 Claims, No Drawings

FUEL COMPOSITIONS FOR CATALYTIC BURNERS

CROSS REFERENCES TO RELATED APPLICATIONS

This application is a continuation-in-part of Application Ser. No. 11/974,455 filed Oct. 12, 2007, which claims the benefit of U.S. Provisional Application 60/851,235, filed Oct. 12, 2006.

FIELD OF THE INVENTION

The invention relates to a burner comprising a supported catalyst that provides flameless combustion of fuels.

BACKGROUND OF THE INVENTION

Flameless catalytic fragrance lamps that auto-catalytically burn a fragrance/fuel mixture to emit a fragrance have been available for over 100 years. The typical fragrance lamps burn fuel that is composed of approximately 90 wt % 2-propanol, 8 wt % water, and 2 wt % fragrance. Currently, there are several flameless catalytic lamps available on the market. The catalytic fragrance lamps currently employ low boiling alcohol-based fuel for several reasons. The fuel is used as a carrier for the fragrance. The fragrance/alcohol mixture is transported from a reservoir to a flameless catalytic burner which simultaneously combusts the alcohol while dispersing the fragrance in the surrounding atmosphere. Alcohols are also used because their high vapor pressure (2-propanol has a vapor pressure of 42.74 mm Hg at 25° C.) allows them to soak the wick, which transports them to the burner very efficiently and allows a sufficient, continual flow of fuel from the reservoir to the catalytic burner. Furthermore, combustion of low boiling alcohols by the catalytic burner produces only small amounts of carbon, or coke, which over several months of intermittent use will cause the catalytic burner to clog and cease operation. Finally, catalytic combustion of 2-propanol produces almost no smoke, so the fragrance is released while not producing any visible smoke from the catalytic fragrance lamps.

However, currently used fuel mixtures will likely face severe use restrictions in the future by regulatory bodies seeking to minimize pollution. The California Air Resources Board (CARB) plans to impose bans on currently used fuel mixtures that contain greater than 18 wt % of alcohol-based fuels. As an example, 2-propanol is classified as a volatile organic compound (VOC), and currently used fuel mixtures contain greater than 18 wt % of 2-propanol relative to the total composition.

In light of the environmental and pollution concerns surrounding currently used fuel mixtures, it is desirable to develop new fuel compositions for use in catalytic fragrance lamps that meet or exceed VOC regulations imposed by regulatory bodies such as CARB. The present invention is directed to the identification and formulation of compounds that will meet the above mentioned requirements and function as suitable fuels for catalytic fragrance lamps.

SUMMARY OF THE INVENTION

An embodiment of the invention is directed to a fuel composition wherein the composition comprises up to 30% water, up to 18% of a flammable compound, 50 to 100% of an exempt compound and 0 to 10% of an active compound.

A further embodiment of the invention is directed to a fuel composition wherein the composition comprises a mixture of one alcohol compound and one non-alcohol compound, wherein the alcohol compound has a vapor pressure less than 100 mm Hg at 20° C.

DETAILED DESCRIPTION OF EXEMPLARY EMBODIMENTS

An embodiment of the invention is directed to a fuel composition that generates lower amounts of VOCs than traditional fuels. Traditional fuels typically have high vapor pressures of greater than 1 mm Hg.

The fuel compositions of the claimed invention are organic compounds that can be burned by a catalytic burner system and which conform to the CARB specifications as exempt compounds under CARB guidelines.

An embodiment of the invention is directed to a fuel composition comprising up to 30% water, up to 18% flammable compound, 50 to 100% of an exempt compound and 0 to 10% of an active compound. The flammable compound can be compounds such as: methanol, ethanol, propanol, 2-propanol, butanol, other flammable compounds, and mixtures thereof. As used herein, the term "exempt compound" refers to any compound or mixtures thereof listed on the EPA's "List of Exempt Compounds" (40CFR51.100 (s)). Exempt compounds include the compounds set forth below:

methane
ethane
methylene chloride (dichloromethane)
1,1,1-trichloroethane (methyl chloroform)
1,1,2-trichloro-1,2,2-trifluoroethane (CFC-113)
trichlorofluoromethane (CFC-11)
dichlorodifluoromethane (CFC-12)
chlorodifluoromethane (HCFC-22)
trifluoromethane (HFC-23)
1,2-dichloro 1,1,2,2-tetrafluoroethane (CFC-114)
chloropentafluoroethane (CFC-115)
1,1,1-trifluoro 2,2-dichloroethane (HCFC-123)
1,1,1,2-tetrafluoroethane (HFC-134a)
1,1-dichloro 1-fluoroethane (HCFC-141b)
1-chloro 1,1-difluoroethane (HCFC-142b)
2-chloro-1,1,1,2-tetrafluoroethane (HCFC-124)
pentafluoroethane (HFC-125)
1,1,2,2-tetrafluoroethane (HFC-134)
1,1,1-trifluoroethane (HFC-143a)
1,1-difluoroethane (HFC-152a)
parachlorobenzotrifluoride (PCBTF)
cyclic, branched, or linear completely methylated siloxanes
acetone
perchloroethylene (tetrachloroethylene)
3,3-dichloro-1,1,1,2,2-pentafluoropropane (HCFC-225ca)
1,3-dichloro-1,1,2,2,3-pentafluoropropane (HCFC-225cb)
1,1,1,2,3,4,4,5,5,5-decafluoropentane (HFC 43-10mee)
difluoromethane (HFC-32)
ethylfluoride (HFC-161)
1,1,1,3,3,3-hexafluoropropane (HFC-236fa)
1,1,2,2,3-pentafluoropropane (HFC-245ca)
1,1,2,3,3-pentafluoropropane (HFC-245ea)
1,1,1,2,3-pentafluoropropane (HFC-245eb)
1,1,1,3,3-pentafluoropropane (HFC-245fa)
1,1,1,2,3,3-hexafluoropropane (HFC-236ea)
1,1,1,3,3-pentafluorobutane (HFC-365mfc)
chlorofluoromethane (HCFC-31)
1-chloro-1-fluoroethane (HCFC-151a)
1,2-dichloro-1,1,2-trifluoroethane (HCFC-123a)
1,1,1,2,2,3,3,4,4-nonafluoro-4-methoxy-butane ($C_4F_9OCH_3$ or HFE-7100)

2-(difluoromethoxymethyl)-1,1,1,2,3,3,3-heptafluoropropane ($(CF_3)_2CFCF_2OCH_3$)

1-ethoxy-1,1,2,2,3,3,4,4,4-nonafluorobutane ($C_4F_9OC_2H_5$ or HFE-7200)

2-(ethoxydifluoromethyl)-1,1,1,2,3,3,3-heptafluoropropane ($(CF_3)_2CFCF_2OC_2H_5$)

methyl acetate 1,1,1,2,2,3,3-heptafluoro-3-methoxy-propane (n-$C_3F_7OCH_3$ or HFE-7000)

3-ethoxy-1,1,1,2,3,4,4,5,5,6,6,6-dodecafluoro-2-(trifluoromethyl) hexane (HFE-7500)

1,1,1,2,3,3,3-heptafluoropropane (HFC 227ea)

methyl formate ($HCOOCH_3$)

1,1,1,2,2,3,4,5,5,5-decafluoro-3-methoxy-4-trifluoromethyl-pentane (HFE-7300)

dimethyl carbonate propylene carbonate and perfluorocarbon compounds which fall into these classes:

(i) cyclic, branched, or linear, completely fluorinated alkanes, (ii) cyclic, branched, or linear, completely fluorinated ethers with no unsaturations, (iii) cyclic, branched, or linear, completely fluorinated tertiary amines with no unsaturations, and (iv) sulfur containing perfluorocarbons with no unsaturations and with sulfur bonds only to carbon and fluorine.

In certain embodiments of the invention, the exempt compounds used in the fuel compositions are acetone and methyl acetate. The active compound can be fragrances, essential oils, odor sequesterants, biocides, insecticides, insect repelling compounds, fungicides, bactericides, virucides, aromatherapy compounds, medicinal compounds, deodorizing compounds, disinfectant compositions, pesticides, herbicides and sanitizers, mixtures thereof; or any compound that can be dispersed into the surrounding atmosphere.

Table 1 below sets forth compounds that can be used in the fuel compositions of the claimed invention. These compounds have a vapor pressure greater than 30 mm Hg at 20° C. In certain embodiments of the invention, the compounds are alcohols. In other embodiments of the invention, the compounds in the fuel composition are non-alcohols.

TABLE 1

| Compound | Formula | Boiling Point | Vapor Pressure (mm Hg at 20° C.) |
|---|---|---|---|
| 2-propanol | $C_3H_80$ | 82.400 | 33.0 |
| ethanol | $C_2H_60$ | 78.500 | 44.3 |
| ethyl acetate | $C4H80_2$ | 77.000 | 72.8 |
| cyclohexane | $C_6H_{12}$ | 80.700 | 78.0 |
| methanol | $CH_4O$ | 64.600 | 96.0 |
| hexane | $C_6H_{14}$ | 69.000 | 120.0 |
| methyl acetate | $C_3H_6O_2$ | 56.900 | 165.0 |
| acetone | $C_3H_6O$ | 56.200 | 180.0 |

Embodiments of the invention are directed to fuel compositions comprising at least one compound having a vapor pressure greater than 30 mm Hg at 20° C. In certain embodiments of the invention, the compound having a vapor pressure greater than 30 mm Hg at 20° C. is an alcohol. In other embodiments of the invention, the compound having a vapor pressure greater than 30 mm Hg at 20° C. is a non-alcohol. In certain embodiments of the invention, fuel compositions of the claimed invention comprise a mixture of at least two compounds, wherein at least one compound is an alcohol. In other embodiments of the claimed invention, fuel compositions of the claimed invention comprise a mixture of at least two compounds, wherein only one compound is an alcohol.

In certain embodiments of the invention, the compositions comprise a mixture of one alcohol compound and one non-alcohol compound, wherein the alcohol compound has a vapor pressure less than 100 mm Hg at 20° C.

In an embodiment of the invention, a fuel composition of the claimed invention comprises at least 70% of an exempt compound and up to 18% of a flammable compound. In an embodiment of the invention, the exempt compound is acetone or methyl acetate. In other embodiments of the invention the flammable compound is methanol, ethanol, propanol, 2-propanol, or butanol.

The fuel compositions of the invention can be used in home fragrance applications, but can also be utilized other markets, such as (but not limited too): pet care, carpet cleaning, industrial, commercial, hotels, nursing homes, geriatrics care related facilities, hospitals, office buildings, medical, day care, schools-institutional, amusement parks, and aquariums.

WORKING EXAMPLES

Example 1

To test the functionality of the fuels, each was placed in a 12 oz glass bottle and burned using either a platinum wick-based catalytic burner or a ceramic based catalytic burner.

In a typical test, the fuel was placed in the 12 oz glass bottle and the catalytic burner was placed on top of the bottle with the cotton wick extending into the fuel. The fuel was allowed to fully saturate the catalytic burner before operation. To ignite the platinum wick-based catalytic burner a flame from a lighter was placed on the metal burner for 10 seconds and then removed. To ignite the ceramic based catalytic burner the flame was used to ignite the fuel in the porous ceramic which generated a flame on the ceramic. The flame was allowed to burn for two minutes and then extinguished.

After the ignition process, the performance of the various fuels was monitored by their effect on the operation of the catalytic burners. If the catalytic process/burning continued until the glass bottle was empty, the fuel was considered successful. However, if the catalytic process/burning stopped before the fuel was consumed, the fuel was deemed unsuccessful.

The tables below set forth various formulations that were tested for their efficacy using catalytic burners.

TABLE 2

| Formulation | Water | Flammable | Acetone | Active | Platinum | Ceramic Burner |
|---|---|---|---|---|---|---|
| (1) | 0.00 | 0.00 | 100.00 | 0.00 | + | − |
| (2) | 5.00 | 0.00 | 95.00 | 0.00 | + | − |
| (3) | 10.00 | 0.00 | 90.00 | 0.00 | + | + |
| (4) | 15.00 | 0.00 | 85.00 | 0.00 | + | + |
| (5) | 20.00 | 0.00 | 80.00 | 0.00 | + | − |
| (6) | 30.00 | 0.00 | 70.00 | 0.00 | + | − |
| (7) | 40.00 | 0.00 | 60.00 | 0.00 | | |

+ = successful
− = unsuccessful

Example 2

The fuels can also be composed of a flammable compound and an Exempt Compound. The table below shows the fuels which were tested that contained acetone as the Exempt Compound and 2-propanol as the flammable compound. The fuels were prepared by mixing the appropriate weight percentages to produce 100.0 grams of fuel. For example, (8) was prepared by mixing 2.0 grams of 2-propanol with 98.0 grams of acetone.

TABLE 3

| Formulation | Water | 2-propanol | Acetone | Active | Platinum | Ceramic |
|---|---|---|---|---|---|---|
| (8) | 0.0 | 2.0 | 98.0 | 0.0 | + | − |
| (9) | 0.0 | 5.0 | 95.0 | 0.0 | + | − |
| (11) | 0.0 | 10.0 | 90.0 | 0.0 | + | + |
| (12) | 0.0 | 15.0 | 85.0 | 0.0 | + | + |
| (13) | 0.0 | 18.0 | 82.0 | 0.0 | + | + |

+ = successful
− = unsuccessful

Example 3

The fuels can also be composed of water, a flammable compound, and an Exempt Compound. The table below shows the fuels which were tested that contained acetone as the Exempt Compound and 2-propanol as the flammable compound and water. The fuels were prepared by mixing the appropriate weight percentages to produce 100.0 grams of fuel. For example, (14) was prepared by mixing 2.0 grams of water, 5.0 grams of 2-propanol, and 98.0 grams of acetone.

TABLE 4

| Fuel | Water | 2-propanol | Acetone | Active | Platinum | Ceramic Burner |
|---|---|---|---|---|---|---|
| (14) | 2.0 | 5.0 | 93.0 | 0.0 | + | − |
| (15) | 5.0 | 2.0 | 93.0 | 0.0 | + | − |
| (16) | 10.0 | 10.0 | 80.0 | 0.0 | + | + |
| (17) | 12.0 | 16.0 | 72.0 | 0.0 | + | + |
| (18) | 20.0 | 18.0 | 62.0 | 0.0 | + | − |

+ = successful
− = unsuccessful

Example 4

The fuels can also be composed of water, a flammable compound, an Exempt Compound, and an active compound such as fragrance. The table below shows the fuels which were tested that contained acetone as the Exempt Compound, 2-propanol as the flammable compound, water, and fragrance as the active compound. The fuels were prepared by mixing the appropriate weight percentages to produce 100.0 grams of fuel. For example, (19) was prepared by mixing 12.0 grams of water, 16.0 grams of 2-propanol, 70.0 grams of acetone, and 2.0 grams of fragrance.

All the fuels in the table were successful in keeping the catalytic process going and with delivering fragrance to the surrounding atmosphere with both the platinum wick and the ceramic based catalytic burner.

TABLE 5

| Fuel | Water | 2-propanol | Acetone | Fragrance |
|---|---|---|---|---|
| (19) | 12.00 | 16.00 | 70.00 | 2.00 |
| (20) | 12.00 | 16.00 | 71.00 | 1.00 |
| (21) | 15.00 | 0.00 | 84.00 | 1.00 |
| (22) | 0.00 | 16.00 | 82.00 | 2.00 |

Example 5

The fuels can also be composed of water, a flammable compound, an Exempt Compound, and an active compound such as essential oils. The example below is a fuel which was tested that contained acetone as the Exempt Compound, 2-propanol as the flammable compound, water, and essential oil as the active compound. The fuel was prepared by mixing the appropriate weight percentages to produce 100.0 grams of fuel. The fuel composition containing essential oil was prepared by mixing 12.6 grams of water, 15.7 grams of 2-propanol, 70.7 grams of acetone, and 1.0 grams of essential oil.

This example details the use of essential oils added individually or in combination to the novel fuel formulation described herein. Essential oils can be added as the active compound for these fuels for use in catalytic burner systems. Depending on the identity and composition of the essential oils, they themselves can be used as the active ingredients in fragrances, insecticides, insect repellants, aromatherapy compounds, medicinal compounds, deodorizing compounds, disinfectant compositions, fungicides, herbicides and sanitizers. They may also be used individually or in combination to produce predetermined, desired effects.

The invention claimed is:

1. A fuel composition wherein said composition comprises between 10% to 30% water, up to 18% of a flammable compound, 50 to 100% of an exempt compound, and up to 10% of an active compound, and wherein the flammable compound has a vapor pressure greater than 30 mm Hg at 20° C.

2. The composition of claim 1, wherein the flammable compound comprises one or more of methanol, ethanol, propanol, 2-propanol, butanol, cyclohexane, hexane, and mixtures thereof.

3. The composition of claim 1, wherein the exempt compound is acetone or methyl acetate.

4. The composition of claim 1, wherein the active compound is selected from the group consisting of, essential oils, pesticides fragrances, odor sequesterants, insecticides, insect repelling compounds, fungicides, aromatherapy compounds, medicinal compounds, deodorizing compounds disinfectant compositions, herbicides, pesticides, sanitizers, and mixtures thereof.

5. The composition of claim 1, the mixture of at least two compounds comprises only one alcohol.

6. The composition of claim 1, wherein the exempt compound has a vapor pressure greater than 30 mm Hg at 20° C. and is a non-alcohol.

7. The composition of claim 1, further comprising at least one of a biocide, bactericide, and virucide.

* * * * *